United States Patent [19]

Kimberlin

[11] 4,329,683

[45] May 11, 1982

[54] BRUSH WEAR INDICATOR FOR A DYNAMOELECTRIC MACHINE

[75] Inventor: Dan W. Kimberlin, Erie, Pa.

[73] Assignee: General Electric Co., Schenectady, N.Y.

[21] Appl. No.: 183,904

[22] Filed: Sep. 4, 1980

[51] Int. Cl.[3] ..... G08B 21/00

[52] U.S. Cl. ..... 340/679; 200/61.4; 310/242

[58] Field of Search ..... 340/679, 648; 200/61.4; 310/239, 245, 72, 242

[56] References Cited

U.S. PATENT DOCUMENTS

| | | | |
|---|---|---|---|
| 2,691,114 | 10/1954 | Lykins | 310/246 |
| 3,523,288 | 10/1979 | Lowther | 310/245 |
| 4,024,525 | 5/1977 | Baumgartner et al. | 340/648 |
| 4,121,207 | 10/1978 | Jones | 340/648 |
| 4,172,988 | 10/1979 | Lowther | 310/245 |
| 4,272,695 | 6/1981 | Buchwald et al. | 310/242 |

*Primary Examiner*—Glen R. Swann, III

*Attorney, Agent, or Firm*—Vale P. Myles

[57] ABSTRACT

A dynamoelectric machine having a rotatable conductor on which a reciprocally mounted brush rides is provided with a brush wear indicator, comprising, an electro-mechanical transducer connected between a self-winding, brush-biasing spring forming part of the brush holder assembly and a brush wear signalling means in order to actuate the signalling means responsive to a predetermined degree of brush wear that causes the brush biasing spring to move an active element of the transducer a predetermined distance thereby effecting such actuation.

16 Claims, 7 Drawing Figures

9A
16
16A
17
16B 16
16A
16B
5B'

15
6
8
7
14
12B
11
1
9
12
9B
10
4B
9A
16
12A
13
5B'
17
12C
5B
5
4
4A
5A
3
4
2

ALARM
6
6A
6B
10
20
11
12F'
12F
22
7"
13"
21
1
12E
4B
20A
20B
12
5B'
4B
5B
5
4
4A
3
2

BRUSH WEAR INDICATOR FOR A DYNAMOELECTRIC MACHINE

BACKGROUND OF THE INVENTION

The invention relates to brush wear indicators for signalling to an operator of a dynamoelectric machine the occurrence of a predetermined degree of wear of the brushes on the machine, more particularly, it relates to brush wear indicators that utilize an electromechanical transducer connected between a signal means and a movable portion of a brush-biasing spring to actuate the signal means responsive to the occurrence of a predetermined degree of brush wear.

In those dynamoelectric machines that utilize brushes to conduct current from a rotor to fixed associated electrical circuits by forming a sliding electrical contact between brushes and either a plurality of slip rings or commutator segments, there always exists the need to periodically replace the brushes as they become worn down by the sliding relationship. In most such machines currently in use, no special brush wear indicating means are used in association with the brushes; instead, the extent of brush wear is periodically determined by visually examining the condition of the brushes. Of course, such physical examination is time consuming and often somewhat difficult to perform because it necessitates removal of housing covers in order to gain access to the brushes for inspection purposes. In addition, in such machines there always exists the danger that the rotor may be damaged if the brush is allowed to become so completely worn that the rivet attaching a shunt conductor to the brush scrapes the rotating commutator or slip ring. On the other hand, in many dynamoelectric machine applications, the anticipated brush life is sufficiently long to make it economically unfeasible to provide an additional brush wear indicating signal means. Also, in many applications of dynamoelectric machines, it is not imperative that the brushes be replaced before they are essentially completely worn out. In such applications a virtually completely worn out brush condition is relied on as a signal means for indicating that condition, and temporary loss of service due to the brush wear is not critical enough to economically justify the provision of separate brush wear indicating means on the machine.

Despite the fact that many dynamoelectric machines are satisfactorily operated without brush wear indicators, there also exists many applications in which brush wear indicators are desirable. In fact, prior to the invention disclosed herein, a number of different brush wear indicating mechanisms have been disclosed. For example, U.S. Pat. No. 2,691,114-Lykins, which issued on Oct. 5, 1954, shows a torsion-spring biased, relatively rigid brush follower arm that is effective to move a switch contact against a fixed switch contact responsive to a predetermined degree of brush wear, thereby to energize a signal circuit that indicates a given degree of such wear. Another type of brush wear indicator is shown in U.S. Pat. No. 3,523,288-Thompson, which issued on Aug. 7, 1970. The invention described in that patent includes a spring-biased pin that is mounted in sliding relationship on one side of a brush so that as the brush wears, the pin eventually drops into a recess in the brush thereby enabling a signal circuit switch to close with a snap action and alert an operator to the predetermined degree of brush wear indicated by the pin reaching the recess in the brush. A somewhat similar brush wear indicating means is shown in U.S. Pat. No. 4,121,207-Jones, which issued on Oct. 17, 1978 and discloses a microswitch used in combination with a switch actuating arm that rolls on the side of the brush until the roller reaches the outer end of the brush and drops off of it to close the micro-switch with a snap action. Yet another U.S. Pat. No. 4,172,988-Lowther, which issued Oct. 30, 1979, describes a brush wear indicator having an electrical contact mounted on the outer end of a brush so that the contact is moved into engagement with a fixed contact that is supported on an insulated member adjacent to the path of travel of the brush. In that system, when a brush is worn, it is moved toward a commutator or slip ring by a self-winding spring until the contact mounted on the brush engages the fixed contact thereby completing a circuit to an indicating signal that alerts an operator to a predetermined degree of brush wear.

All of the above-noted prior art brush wear mechanisms are either relatively expensive to manufacture because they require the assembly of a number of additional parts that normally are not required in brush holder and biasing structures, or they require the provision of extra movable switch contacts that are actuated by a mechanism that is directly mounted on a brush that is being monitored, as in the Lowther patent. In addition, some of these prior art mechanisms are relatively expensive because their use requires special machining and assembling procedures such as those needed to implement the invention described in the above-noted Jones patent wherein a separately mounted microswitch arm operates through an aperture that must be formed in a wall of a conventional brush holder.

In addition to the prior art brush wear indicators described by the above-mentioned patents, there is disclosed in a co-pending U.S. patent application Ser. No. 183,896 a brush wear indicator that utilizes a self-winding, brush-biasing spring of a relatively conventional brush holder assembly to control the energization of a brush wear indicating circuit. Briefly stated, in that invention, which is also assigned to the assignee of the present invention, a so-called negator spring of the brush holder assembly is positioned in electrical engagement with two or more electrical contacts to complete a circuit between the contacts when an associated brush in the brush holder is in a new, or relatively unworn, condition. As the brush wears, the negator spring winds on itself and sequentially moves out of contact with the respective fixed contacts, thereby de-energizing indicating circuits that are each connected, respectively, to one of the fixed contacts and a common contact. In another copending U.S. patent application, Ser. No. 183,920 there is disclosed another type of brush wear indicator that also utilizes a so-called negator spring of a relatively conventional type of brush holder assembly in order to control actuation of a brush wear indicating signal circuit. That invention is also assigned to the assignee of the present invention. In the apparatus disclosed by Michael, a negator spring is operable to close an indicating circuit to energize an indicating means, responsive to a coiled portion of the spring being moved into engagement with a flexible contact mounted near the fixed base of the spring, or into engagement with a switch mounted in a similar position, responsive to the occurrence of a predetermined degree of brush wear.

Although the inventions disclosed in those two copending patent applications utilize a self-winding negator spring to control actuation of a brush wear indicating signal means, they rely on a coiled portion of a negator spring to directly engage a circuit closing or actuating contact or switch rather than employing an electro-mechanical transducer connected between the negator spring and an indicating circuit to electrically isolate the spring from the circuit controlling means in the manner disclosed herein.

Accordingly, it is an object of the present invention to provide a brush wear indicator that is economical to manufacture, reliable in operation and overcomes the disadvantages of prior art brush wear indicators.

Another object of the invention is to provide a brush wear indicator including an electro-mechanical transducer that can be readily retrofitted to a conventional brush holder assembly to indicate a predetermined degree of brush wear responsive to a brush-biasing spring moving a preselected distance to thereby actuate the transducer and cause it to energize an indicating signal.

A further object of the invention is to provide a brush wear indicator that utilizes a relatively conventional self-winding brush-biasing spring of a brush holder assembly to operate an electro-mechanical transducer mounted on the brush holder radially outward from the path of movement of the brush-biasing spring, thereby to close a pair of relatively movable contacts which control actuation of a brush wear signal means.

Still another object of the invention is to provide a brush wear indicator in which a dielectric coupling is formed between a brush holder negator spring and a movable contact that is operated by a transducer to move into engagement with a fixed contact responsive to the occurrence of a predetermined degree of brush wear. An additional object of the invention is to provide a brush wear indicator that operates in combination with standard brushes, i.e., brushes that need not be modified from current commercially available designs in order to be compatible for use with the brush wear indicator.

Additional objects and advantages of the invention will become apparent to those skilled in the art from the description of it presented herein.

SUMMARY OF THE INVENTION

In the preferred embodiments of the invention disclosed herein, a brush wear indicator for a dynamoelectric machine is provided for signalling the occurrence of a predetermined degree of brush wear. The indicator mechanism includes an electromechanical transducer that is operably connected between a negator spring of a relatively conventional brush holder assembly and a movable electrical contact that forms part of a signal circuit. A variety of bracket structures are disclosed for supporting a fixed electrical contact in the path of movement of the movable contact, and resilient biasing means are connected to the transducer in order to bias the movable contact away from the fixed contact. Signal circuit means are connected in series with the fixed and movable contacts so that when the negator spring winds up responsive to the occurrence of a predetermined degree of brush wear, it causes the transducer to move the movable contact into engagement with the fixed contact and thereby energize the signal circuit to indicate a given degree of brush wear.

DESCRIPTION OF THE PREFERRED EMBODIMENTS

Figures 1, 1A, 1B:
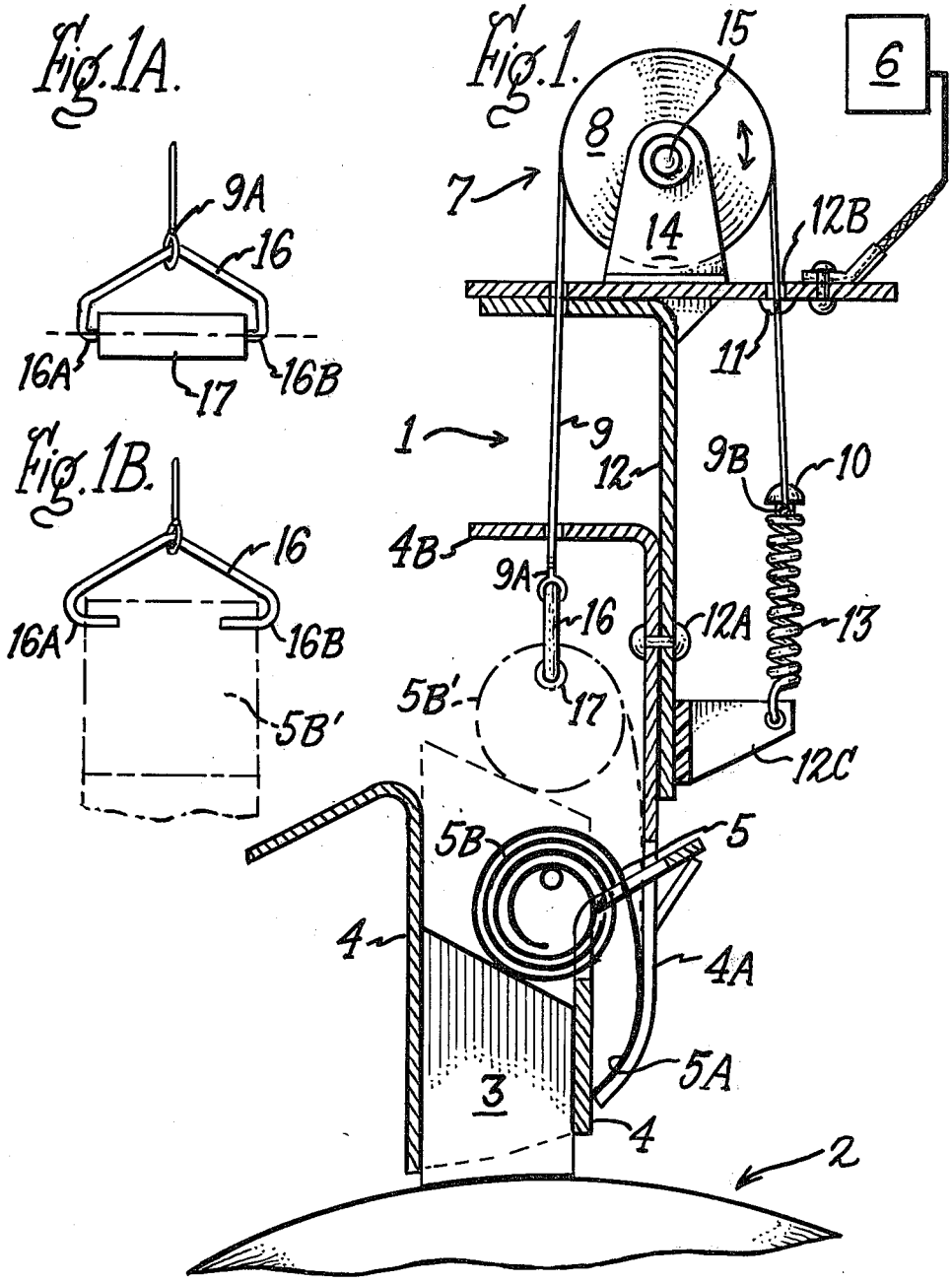
FIG. 1 is a schematic side elevation, partly in cross-section showing one embodiment of a brush wear indicator in combination with a fragment of a rotatable conductor such as a slip ring or commutator, and including circuit means for connecting the indicator to a signalling circuit, according to the invention.
FIG. 1A is a fragmentary plan view of a mechanical coupling means used to couple the brush wear indicator shown in FIG. 1 to a coiled portion of a brush biasing, self-winding spring, according to one embodiment of the invention.
FIG. 1B is another mechanical coupling means for connecting the brush wear indicator shown in FIG. 1 to the coiled portion of a brush-biasing spring, according to another form of the invention.

Several different preferred species of the invention will be described herein to clearly explain its advantages relative to known prior art brush wear indicators. In describing the different species, common reference numerals will be used to identify similar parts throughout the specification in order to facilitate an easy comparison of the different disclosed embodiments. Referring first to FIGS. 1, 1A and 1B, it will be seen that there is shown a brush wear indicator 1 that is suitable for use in combination with a dynamoelectric machine that has a rotatably mounted electrical conductor, such as a slip ring or commutator segments 2, shown schematically in FIG. 1. As is generally well known in the field of dynamoelectric machine design, it is conventional to provide a plurality of brushes, such as the brush 3, each slidably positioned and supported for reciprocal movement relative to rotatable conductors (2) by being mounted in a suitable brush holder. In this form of the invention a part of such a brush holder 4 is depicted in cross-section as a conventional tubular member that is generally rectangular to slidably receive brush 3 therein. A self-winding brush-biasing so-called negator spring 5 is mounted with one of its ends 5A supported in fixed relation to a spring holder 4A. A coiled portion 5B of the spring is effective to rest on the outer end of the brush 3 supported in the brush holder in order to bias the brush toward the rotatable conductor 2. As is shown to those skilled in the art, the spring holder 4A is pivotally mounted for a restricted range of operative movement relative to brush holder 4. Thus it will be seen that the end 5A of the spring is mounted in generally fixed operative position relative to the brush holder 4, even though limited pivotal movement of spring holder 4A can occur during operation of the machine, and even though the spring holder may be removed from the brush holder by a manual operation in order to place a new brush in the brush holder 4.

According to the present invention, a signal means 6, which may be of any suitable conventional form, such as a glow lamp or horn, is provided for indicating a predetermined degree of wear of the brush 3. An electrochemical transducer 7 is connected between the coiled portion of the negator spring and the signal means 6 to actuate the signal means responsive to the coiled portion of the spring 5 being moved a predetermined distance toward the rotatable conductor 2 when a predetermined degree of wear of the brush 3 has occurred. An operator of the machine is, thus, alerted by actuation of the signal means 6 to the occurrence of the predetermined degree of brush wear, according to one of the objects of the invention.

In the species of the invention shown in FIG. 1, the transducer 7 comprises a rotatably mounted pulley 8 around which a flexible line 9 is operably positioned as shown in FIG. 1. One end 9A of the line 9 is mechanically coupled to the coiled portion 5B of the spring 5 while the other end 9B of the line is connected to a movable electrical contact 10 by a suitable fastening means. In this form of the invention, the contact 10 is provided with an aperture through its center and the end 9B of line 9 is knotted after being inserted through the aperture in contact 10 to prevent it from slipping back through the contact. Of course, other suitable fastening means may be used in other embodiments of the invention. A second electrical contact 11 is mounted in fixed relationship on a bracket 12 as shown in FIG. 1, and the bracket is supported in any suitable conventional manner, such as by the rivet 12A shown in FIG. 1, to a brush back strip 4B, or to a suitable alternative associated brush supporting mechanism (not shown). The bracket assembly 12 includes an aperture 12B arranged to have the end 9B of the flexible line passed through it, and the fixed contact 11 also contains an aperture through its center portion that is in alignment with the aperture 12B so that the flexible line 9 can slide through these aligned apertures as the pulley 8 rotates. Accordingly, the fixed contact 11 is positioned in the path of movement of the movable contact 10 so that movement of the coiled portion 5B of the negator spring causes the flexible line 9 to move around the pulley 8 and drive the movable contact into engagement with the fixed contact responsive to the occurrence of the predetermined degree of brush wear that will result in such engagement of the contacts.

In order to bias the movable contact 10 away from the fixed contact 11, a second spring 13 is connected to an arm 12C on the bracket 12 and to the movable contact 10 by any suitable conventional joining means, as shown in FIG. 1, so that the spring 13 is placed in tension by the force exerted on it by the line 9 coupled to the negator spring 5. The biasing force of the second spring 13 is less than the biasing force of the negator spring 5, so that the position of the coiled portion 5B of the negator spring determines the position of the movable contact 10, according to the invention. In this form of the invention the arm 12C is made of dielectric material to electrically isolate the contact 10 from the voltage on brush 3. Those skilled in the art will readily appreciate that either or both of the contacts 10 and 11 can be electrically insulated from the voltage on brush 3, depending on whether or not it is desired to use the voltage on brush 3 to energize the brush wear signal circuit 6. If a separate source of energizing current is to be used for actuating the signal means 6, both of the contacts 10 and 11 will be insulated from the bracket 12, which is electrically connected to the brush 3. For example, such a separately energized signal means used in combination with insulated sensor switch contacts is shown in U.S. Pat. No. 3,354,273-Bleiman.

It will be recognized that any suitable conventional means may be used to mount the pulley 8 in rotating relationship to the bracket 12. For this purpose there is shown in the embodiment of the invention illustrated in FIG. 1 a relatively conventional block 14 and associated pin 15 that are mounted on the bracket 12 in a conventional manner, such as by welding the base of block 14 to the bracket.

In FIG. 1 the end 9A of the flexible line 9 is shown mechanically coupled to the coiled portion 5B′ of the negator spring 5 shown in phantom in an extended condition of the negator spring that would be its position when a relatively new or unworn brush 3 is mounted in the brush holder. Responsive to a predetermined degree of brush wear occurring, as is the condition of the brush 3 shown in FIG. 1, the coiled portion 5B of spring 5 would be wound up in the position shown in the solid line drawing in FIG. 1; thus, the end 9A of the line 9 would be drawn downward due to its mechanical coupling with the coiled portion 5B, thereby rotating the pulley 8 and causing the flexible line to move movable contact 10 into electrically conductive engagement with fixed contact 11. When the two contacts are engaged, the signal means is energized by suitable associated circuitry connected in series with the contacts 10 and 11 in any suitable conventional manner, not specifically illustrated in FIG. 1, but more fully described below with reference to the other figures of the drawing.

In the form of the invention shown in FIG. 1, the mechanical coupling means used to couple the end 9A of line 9 to the coiled portion 5B (or 5B′) of the negator spring can take several forms. As more clearly shown in FIG. 1A, the form of the coupling mechanism employed in the embodiment of FIG. 1 comprises a metal slider 16 to which the end 9A of the line is tied. The end arms 16A and 16B of the slider extend, respectively, into opposite ends of a plastic sleeve 17 and support the sleeve in rotating relationship against the inner surface of the coiled portion of the negator spring. The slider 16 is formed to at least partially surround one side of the coiled portion 5B of the negator spring so that as the coiled portion winds up it moves the slider toward the rotatably mounted conductor 2, and the sleeve 17 rotates on the slider. In another form of the coupling means 16, as shown in FIG. 1B, only a metal slider 16, including the arms 16A and 16B, is used, so that the slider is operable to slide directly on the inner surface of the coiled portion of the negator spring 5.

Figure 2B:
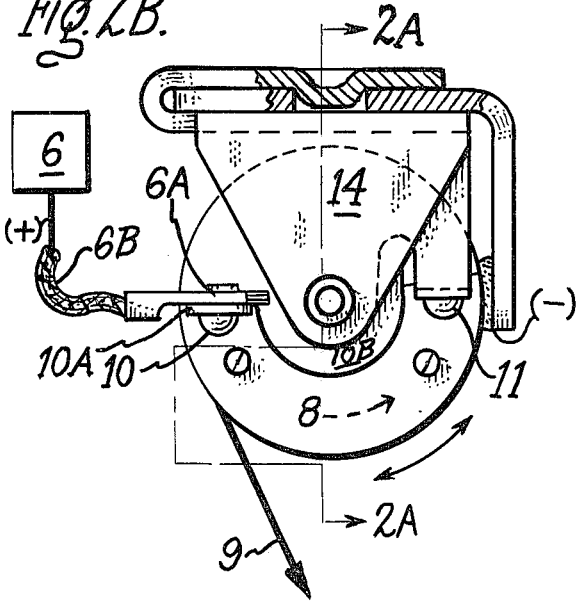
FIG. 2B is a side elevation of the pulley and associated block and pin means for supporting the pulley shown in FIGS. 2 and 2A illustrating the relatively movable contact used in this embodiment of the invention, and showing a portion of an electrical signal circuit to which one of the contacts is connected.
Figure 2A:
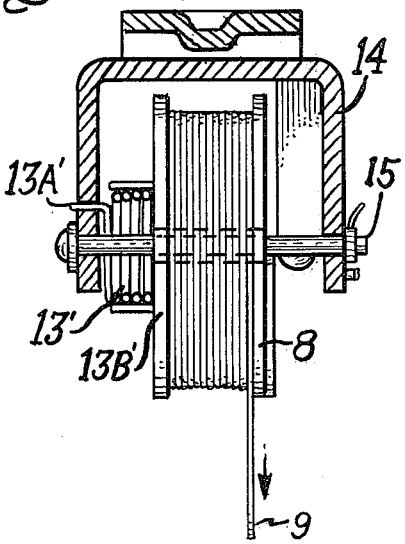
FIG. 2A is a side plan view partly in cross-section on the plane 2A—2A shown in FIG. 2B, of a portion of the brush wear indicator shown in FIG. 2, depicting a pulley and torsion biasing means for rotating the pulley in a direction opposite to that indicated by the arrow adjacent the line wound on the pulley in this figure.
Figure 2:
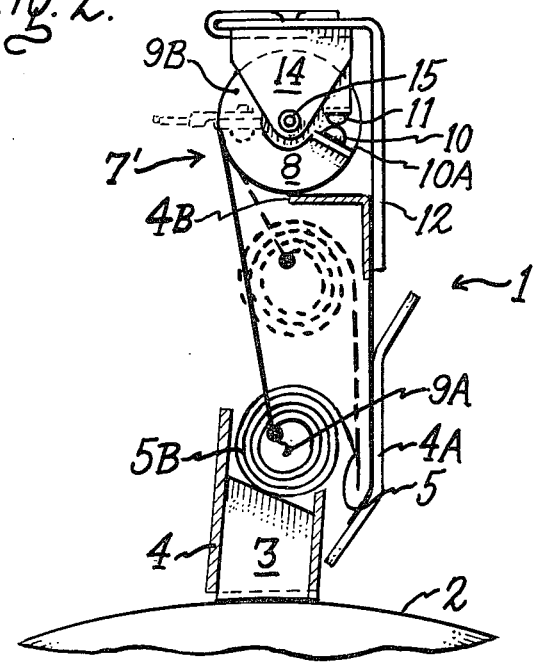
FIG. 2 is a side elevation, party in cross section, of another embodiment of the brush wear indicator of the invention, shown mounted in operating relation to a portion of a rotatable conductor such as a slip ring or commutator, and including circuit means for connecting the indicator to a signal circuit according to the invention.

Referring now to FIGS. 2, 2A and 2B, a second species of the invention will be described using the same numbers used in the foregoing figures of the drawing to describe like components. Thus, in FIG. 2, there is shown a brush wear indicator 1 mounted in operating relationship to a rotatable conductor 2, which it will be understood is either a slip ring or a conventional commutator, on which there is positioned a brush 3 that is reciprocally mounted in a relatively conventional brush holder assembly 4. A spring holder 4A supports a so-called negator spring 5 having a coiled portion 5B, that is also shown in phantom as 5B', in an extended position indicative of the two conditions of brush wear described above with reference to the embodiment of the invention illustrated in FIG. 1. A bracket 12 is mounted on a brush back strip 4B or on an associated yoke structure, by a suitable conventional mounting means, and supports a block 14 and associated axial pin 15 on which a pulley 8 is rotatably mounted. The bracket 12 also has mounted thereon in fixed relationship a fixed contact 11.

In this species of the invention the electromechanical transducer 7' comprises the rotatably mounted pulley 8 on which an electric contact 10 is mounted for rotation with the pulley. Any suitable means, such as the mounting bracket 10A shown in FIG. 2, can be used to support the contact 10 on the pulley 8. The transducer 7' also includes a flexible line 9 having one of its ends 9A mechanically connected to move with the coiled portion 5B of negator spring 5 and having its other end 9B secured to a predetermined point on the pulley 8 for rotation therewith. The end 9A of the flexible line may be connected to the coiled portion 5B of the self-winding spring by a coupling means such as those shown in FIGS. 1A and 1B and described above, or may be suitably coupled by other coupling means according to the invention.

In the enlarged view of the block 14 and associated pulley 8 shown in FIG. 2B, the movable contact 10 is shown in abutment with a fixed terminal 6A which is connected by conventional circuit means 6B to a signal 6. The terminal 6A is maintained in constant electrical contact with the movable contact 10 by a semi-circular electrical conductor 10B mounted on the pulley 8; thus, as the coiled portion 5B of negator spring 5 winds upon itself to move downward, as seen in FIG. 2, responsive to the occurrence of brush wear, the pulley 8 is rotated due to the force applied to it through the flexible line 9 and thereby moves the contact 10 toward the fixed contact 11 until it finally engages that contact, as shown in FIG. 2. Such engagement completes an electrical circuit from the fixed contact 11, through the movable contact 10 and the conductive strip 10B to the terminal 6A and thence to the signal means 6 to signal an operator of the occurrence of the predetermined degree of brush wear.

As noted above during the description of the species of the invention shown in FIG. 1, in the species of the invention depicted in the FIGS. 2 and 2A the circuit means 6B is electrically connected in series with the fixed and rotatable contacts 10 and 11, and the signal means 6, so that closure of the contacts is effective to energize the signal means 6 and indicate the predetermined degree of brush wear. If voltage from the brush 3 is to be used to energize the signal means 6, the contact 10 would be electrically insulated from the brush 3 in any well known manner, such as by forming the pulley 8 of dielectric material. Alternatively, as explained above, a conventional, separately energized signal circuit should be employed by insulating both contacts 10 and 11 from bracket 12.

In addition to the biasing force applied to the pulley 8 by the action of the negator spring 5 through the flexible line 9, the species of the invention shown in FIG. 2 includes a second spring 13' having a biasing force on the pulley 8 that is weaker than the force of rotation applied to it by the negator spring through the flexible line 9. The second spring 13' is mounted around the pin 15 in block 14, as shown in FIG. 2A, and has one of its ends 13A' mounted in the block 14 and the other of its ends 13B' secured in fixed relation to the pulley 8 so that the spring 13' exerts a continuous torsion force biasing the pulley to rotate in a direction opposite to the direction of rotation in which it is biased by the negator spring 5. Accordingly, when the negator spring is manually extended, to the position shown in phantom in FIG. 2, to accept a new brush in the brush holder 4, the second spring 13' causes the pulley 8 to rotate and move the contact 10 to the position shown in 2B.

In order to electrically isolate the movable contact from the fixed contact 11 in this species of the invention, the flexible line 9 is made of dielectric material and the pulley 8 is also formed of a suitable dielectric material. Of course, other conventional electrical insulating means could be used in alternative embodiments of the invention to accomplish this objective.

As best seen in FIG. 2, the pulley 8 is mounted radially outward from the rotatable conductor 2 and the reciprocally mounted brush 3 so that the path of movement of the portion of line 9 that is not engaged with the pulley is generally parallel to the path of movement of the coiled portion 5A of the negator spring 5. This mounting relationship assures free movement of the negator spring to enable it to successfully perform its brush-biasing objective. The arrangement also facilitates retrofitting of the brush wear indicator 1 onto relatively conventional brush holders such as brush holder 4, which are currently in wide spread commercial use.

Figure 3:
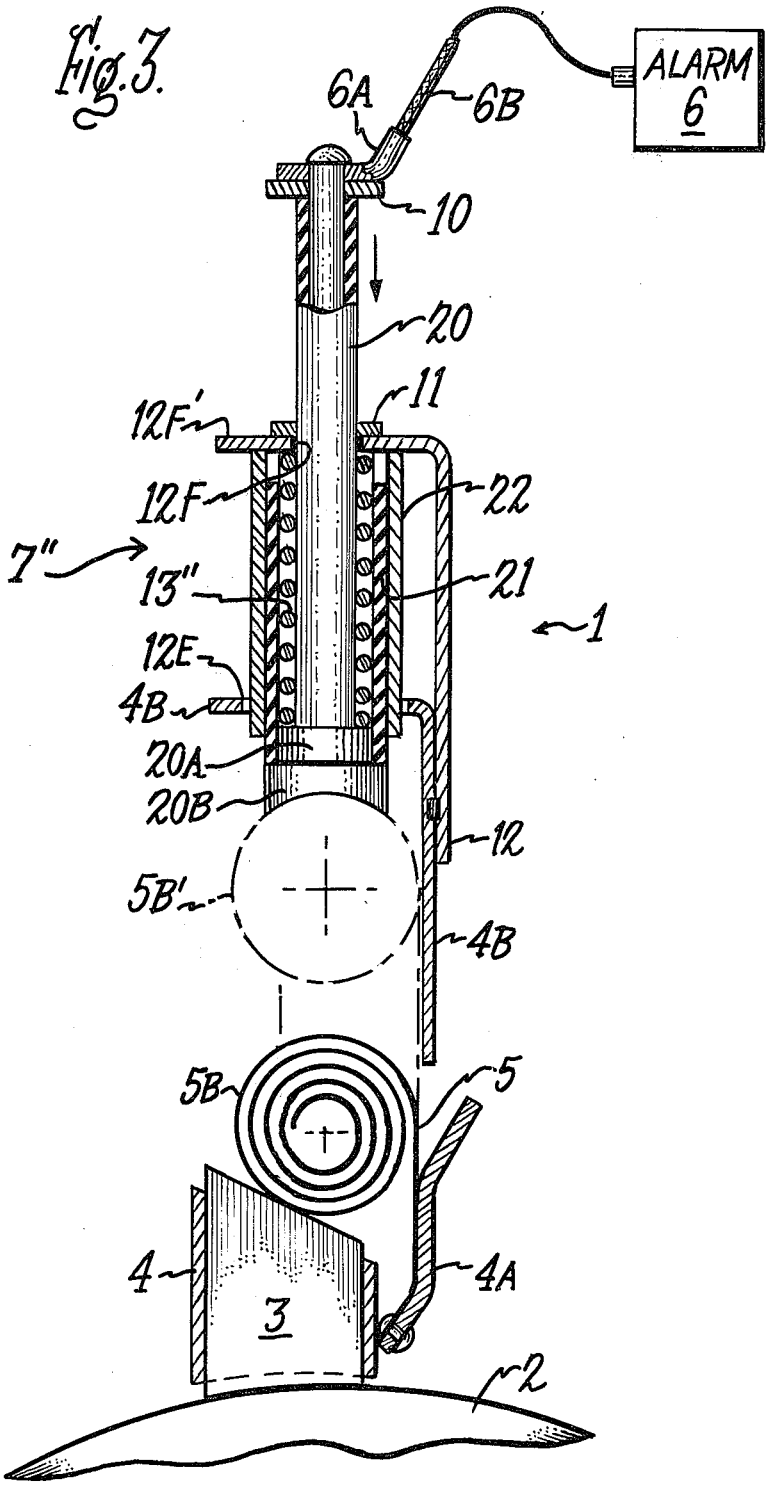
FIG. 3 is a side plan view, party in cross-section, of a third embodiment of the invention showing a brush wear indicator mounted in operating relationship to a relatively conventional brush holder assembly and associated self-winding, brush-biasing spring. A reciprocal plunger is biased against a so-called negator spring of the brush holder assembly and controls movement of a contact that is operable to engage a second fixed contact on the bracket supporting the brush wear assembly, thereby to energize an alarm circuit for indicating a predetermined degree of brush wear according to the invention.

A third species of the invention is illustrated in FIG. 3 of the drawing, and the same identifying numerals are used to designate parts similar to those illustrated in FIGS. 1 and 2. Thus, there is shown in FIG. 3 a brush wear indicator 1 mounted in operating relationship to a rotatable conductor 2 having a brush 3 riding thereon and reciprocally mounted in a brush holder 4. A spring holder 4A supports a self-winding spring 5 having a coiled portion 5B, also shown in phantom at 5B', to bias the brush 3 toward the rotatable conductor 2. An electro-mechanical transducer 7'' including a bracket 12 mounted in any suitable manner to the brush back strip 4B, or an associated yoke assembly, supports a fixed contact 11. The transducer also includes a reciprocally mounted rigid link 20 having one of its ends 20B formed to define an arcuate surface that generally conforms to the outer surface of the coiled portion 5B of the self-winding spring 5, as shown in FIG. 3. A movable contact 10 is mounted on the other end of the link 20 and is operable to be moved into engagement with the fixed contact 11, which is mounted in the path of movement of the contact 10, responsive to the occurrence of a predetermined degree of brush wear. The transducer 7'' also includes a resilient means 13'', which in this embodiment of the invention is a coiled spring mounted in compression between a shoulder 20A on the link 20 and an arm 12F' of the bracket 12, as shown in FIG. 3. The spring 13'' is operable to bias the link 20 into engagement with the outer surface of the coiled portion 5B of the self-winding spring, thereby causing the link to follow the movement of the coiled portion of the negator spring toward the rotatable conductor 2 responsive to the occurrence of wear on the brush 3. Suitable electrical circuit means such as the terminal 6A and conductor 6B shown in FIG. 3 are connected to a signal means, which may be a conventional glow lamp or audible signal means or other alarm that is effective to alert an operator to the occurrence of the predetermined degree of brush wear responsive to closure of the contacts 10 and 11. Preferably the signal means 6 is electrically connected in series with the movable contact 10 and fixed contact 11, as is the case in the illustrated embodiment of the invention, so that the signal means is energized responsive to closure of the contacts. Of course, it will be understood that other relatively conventional signal circuit means may be employed so that the signal means 6 would be normally energized when the contacts 10 and 11 are open, and deenergized when those contacts are closed. Also, it will be recognized that a suitable source of power will be provided in the circuit means of the invention to actuate the signal means 6.

In order to confine the rigid link 20 and biasing spring 13'' in this form of the invention, a dielectric sleeve 21 is positioned around the plunger and is secured to the shoulder 20A, and a second sleeve 22 is mounted to extend between the spaced apertures 12E and 12F. Thus, as the spring 13'' forces the link 20 to move downward, the sleeve 21 is carried downward along with the shoulder 20A of the link while the second sleeve 22 remains in its fixed position relative to the arm 12F' to which it is secured. Accordingly, the biasing spring is completely surrounded at all times by one or both of the sleeves. In this form of the invention, the link 20 is made of dielectric material so that the movable contact 10 is always electrically isolated from the contact 11 until it is moved into engagement therewith responsive to the occurrence of the predetermined degree of brush wear that enables the link 20 to move downward sufficiently to cause such contact engagement.

From the foregoing description of the invention it will be apparent to those skilled in the art that various further modifications and alternative embodiments of it can be developed; accordingly, it is my intention to encompass within the following claims the true spirit and scope of the invention.

What I claim and desire to secure by Letters Patent of the United States is:

1. A brush wear indicator for a dynamoelectric machine having a rotatably mounted electrical conductor on which a brush is slidably positioned and supported in a brush holder for reciprocal movement relative to the conductor, comprising: a self-winding, brush-biasing spring having one of its ends mounted in generally fixed operative relation to the brush holder and having a coiled portion at its outer end that is effective to rest on the outer end of a brush supported in the holder to bias the brush toward the rotatable conductor, a signal means for indicating a predetermined degree of brush wear, an electro-mechanical transducer operably connected between the coiled portion of said spring and the signal means to actuate the signal means responsive to the coiled portion of the spring being moved a predetermined distance toward the rotatable conductor as a predetermined degree of brush wear occurs whereby an operator is alerted by actuation of the signal means to the occurrence of said predetermined degree of brush wear.

2. A brush wear indicator as defined in claim 1 wherein said transducer comprises a rotatably mounted pulley, a flexible line operably positioned around the pulley and having one of its ends mechanically coupled to the coiled portion of said spring and having its other end mechanically connected to move a movable electrical contact, and a fixed contact mounted in the path of movement of said movable contact whereby movement of the coiled portion of said spring causes the flexible line to move around the pulley and drive the movable contact into engagement with the fixed contact responsive to the occurrence of said predetermined degree of brush wear.

3. A brush wear indicator as defined in claim 2 including a bracket mounted in fixed relationship adjacent to the brush holder, said pulley being mounted on the bracket radially outward from said brush to position the flexible line in general alignment with the path of movement of the coiled portion of said self-winding spring, and a second spring coupled in tension between the bracket and the end of said flexible line that is effective to move the movable contact, said second spring being operable to bias the movable contact away from the fixed contact.

4. An invention as defined in claim 3 wherein said fixed contact is mounted on the bracket and the bracket and fixed contact each have apertures through them that are in alignment to enable the flexible line to slide through said apertures as the line is moved responsive to the self-winding spring coiling up.

5. An invention as defined in claim 4 wherein said flexible line is mechanically coupled to said coiled portion of the self-winding spring by being secured to a slider that is formed to at least partially surround one side of said coiled portion and slide thereon as the coiled portion winds up thereby moving the slider toward said rotatably mounted conductor.

6. An invention as defined in claim 5 wherein said slider includes a rotatable sleeve mounted on arms of the slider and operable to rotate on the inner surface of the coiled portion of the self-winding spring as it winds up.

7. A brush wear indicator as defined in claim 1 wherein said transducer comprises a rotatably mounted pulley having an electrical contact mounted on it, a flexible line mechanically connected between the coiled portion of the spring and a predetermined point on said pulley whereby movement of the coiled portion of the spring responsive to brush wear causes the line to be drawn toward the rotatable conductor, and causes the pulley to rotate and move the contact thereon into engagement with a fixed contact mounted in the path of movement of the contact on the pulley, responsive to the occurrence of said predetermined degree of brush wear.

8. A brush wear indicator as defined in claim 7 including electric circuit means connected in series with said fixed and rotatably mounted contacts with a signal means that is actuated responsive to said contacts being moved into engagement with one another, whereby said signal means is effective to indicate the predetermined degree of brush wear.

9. A brush wear indicator as defined in claim 8 including a second spring mounted to bias the pulley member in a direction causing it to rotate and move the contact thereon away from said fixed contact responsive to said self-winding spring being straightened sufficiently to accept a new brush in the brush holder.

10. A brush wear indicator as defined in claim 9 wherein the biasing force of said second spring on said pulley is weaker than the force of rotation applied to the pulley by the self-winding spring, through the flexible line connected between said spring and pulley.

11. A brush wear indicator as defined in claim 10 wherein said flexible line is formed of a dielectric material, and wherein said pulley is mounted radially outward from the rotatable conductor and the reciprocally mounted brush, with the path of movement of the portion of said line that does not engage the pulley being generally parallel to the path of movement of the coiled portion of said spring.

12. An invention as defined in claim 11 including a bracket mounted adjacent to the brush holder, said bracket including a block and pin for rotatably mounting the pulley radially outward from the self-winding spring and in general alignment with the path of movement of said coiled portion of the spring, said second spring being mounted in torsion around said pin with one end of the second spring secured in relatively fixed relation to said block and with the other end of said second spring secured in relatively fixed relation to a point on said pulley spaced radially outward from the pin on which the pulley rotates.

13. A brush wear indicator as defined in claim 1 wherein said electro-mechanical transducer comprises a reciprocally mounted, generally rigid link having one of its ends resting on the coiled portion of said spring and having an electrical contact mounted to move with the link thereby to move said contact into engagement with a fixed electrical contact mounted adjacent to the path of travel of the link, and resilient means for biasing the link into engagement with the coiled portion of said spring to cause the link to follow the movement of the coiled portion of the spring toward the rotatable conductor responsive to the occurrence of brush wear.

14. An invention as defined in claim 13 including circuit means for electrically connecting the signal means in series with said movable and fixed contacts thereby to make said contacts operable to energize or de-energize the signal means responsive to the movable contact being moved into engagement with, or disengagement from, the fixed contact.

15. An invention as defined in claim 14 including a bracket mounted adjacent to said brush holder and projecting radially outward from said brush, said bracket being formed to define a pair of spaced apertures within which said link is reciprocally mounted, and a sleeve positioned around the link and extending between said spaced apertures, said means for biasing the link comprising a coiled spring positioned within the sleeve and compressed between a shoulder on the link and a portion of the bracket adjacent one of said apertures therein.

16. An invention as defined in claim 15 wherein said link is formed of rigid dielectric material and has the end thereof riding on the self-winding spring formed in an arcuate surface that generally conforms to the outer surface of said coiled portion of said self-winding spring.

* * * * *